US008876238B2

(12) United States Patent
Suzuki

(10) Patent No.: US 8,876,238 B2
(45) Date of Patent: Nov. 4, 2014

(54) IMAGE RECORDING APPARATUS, METHOD FOR PRODUCING TEST PATTERN IN THE SAME, AND NONTRANSITORY STORAGE MEDIUM STORING PROGRAM

(75) Inventor: Katsuaki Suzuki, Gifu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 214 days.

(21) Appl. No.: 13/434,569

(22) Filed: Mar. 29, 2012

(65) Prior Publication Data

US 2012/0274693 A1 Nov. 1, 2012

(30) Foreign Application Priority Data

Apr. 28, 2011 (JP) ..... 2011-101559

(51) Int. Cl.
*B41J 29/38* (2006.01)
*B41J 2/21* (2006.01)

(52) U.S. Cl.
CPC ..... *B41J 29/38* (2013.01); *B41J 2/2114* (2013.01)
USPC ..... 347/14

(58) Field of Classification Search
CPC ..... B41J 29/38
USPC ..... 347/14
See application file for complete search history.

(56) References Cited

U.S. PATENT DOCUMENTS

2009/0289985 A1 11/2009 Sumida et al.
2011/0096115 A1* 4/2011 Mizutani ..... 347/14

FOREIGN PATENT DOCUMENTS

JP 2009-279777 A 12/2009

* cited by examiner

*Primary Examiner* — Alessandro Amari
*Assistant Examiner* — Alexander C Witkowski
(74) *Attorney, Agent, or Firm* — Baker Botts L.L.P.

(57) ABSTRACT

An image recording apparatus, including: a first head for ejecting first liquid for recording; a second head for ejecting second liquid; and a controller. The controller selects, based on the image data, one of waveforms for ejecting the first liquid for each pixel and supplies, to the first-liquid ejection head, a drive signal based on the selected waveform. The controller selects, based on the image data, one of the of waveforms for ejecting the second liquid for each pixel and supplies, to the second-liquid ejection head, a drive signal based on the selected waveform. The controller determines whether recording of a test pattern using the second liquid is required, and when the recording of the test pattern using the second liquid is required, selects the waveform such that the first liquid is not ejected.

10 Claims, 6 Drawing Sheets

FIG.4A

| THRESHOLD VALUE | GRAY LEVEL VALUE | QUATENARIZATION | EJECTION AMOUNT |
|---|---|---|---|
| 63 | 0~63 | 00 | 0 |
| 127 | 64~127 | 01 | SMALL DROPLET |
| 191 | 128~191 | 10 | MEDIUM DROPLET |
| | 192~255 | 11 | LARGE DROPLET |

FIG.4B

| THRESHOLD VALUE | GRAY LEVEL VALUE | QUATENARIZATION | EJECTION AMOUNT |
|---|---|---|---|
| 255 | 0~63 | 00 | 0 |
| – | 64~127 | 00 | 0 |
| – | 128~191 | 00 | 0 |
| | 192~255 | 00 | 0 |

IMAGE RECORDING APPARATUS, METHOD FOR PRODUCING TEST PATTERN IN THE SAME, AND NONTRANSITORY STORAGE MEDIUM STORING PROGRAM

CROSS REFERENCE TO RELATED APPLICATION

The present application claims priority from Japanese Patent Application No. 2011-101559, which was filed on Apr. 28, 2011, the disclosure of which is herein incorporated by reference in its entirety.

BACKGROUND OF THE INVENTION

1. Field of the Invention

The present invention relates to an image recording apparatus configured to eject, onto a recording medium, second liquid for coagulating or precipitating a constituent of first liquid before the first liquid is ejected, and relates to a method for producing a test pattern in the image recording apparatus and a nontransitory storage medium storing a program to be executed by a computer of the image recording apparatus.

2. Description of the Related Art

There is known a printer configured to eject pretreatment liquid (second liquid) for coagulating or precipitating a coloring agent of ink (first liquid) in order to reduce spreading of the ink formed on a sheet. In such a printer, the pretreatment liquid is ejected, before the ink is ejected, onto areas on each of which a dot is to be formed.

SUMMARY OF THE INVENTION

From a viewpoint of reducing consumption of the pretreatment liquid, the pretreatment liquid is preferably applied only to areas on each of which an ink dot is to be formed. In some printers, a control circuit is configured to execute an ejection control using image data for an image to be recorded, such that the ink and the pretreatment liquid are ejected onto the same positions. In this configuration, it is possible to consider that the printer is configured such that the pretreatment liquid is not applied in the recording depending upon needs of a user. However, since the pretreatment liquid is transparent, it has not been assumed that recording is performed by ejecting only the pretreatment liquid without ejecting the ink. However, an inventor of the present invention has found that, when a test pattern is recorded for adjusting a pretreatment-liquid head, the pretreatment-liquid head can be suitably adjusted by the test pattern using only the pretreatment liquid.

This invention has been developed to provide an image recording apparatus, a method for producing a test pattern in the image recording apparatus, and a nontransitory storage medium storing a program to be executed by a computer of the image recording apparatus, capable of recording a test pattern only using second liquid without its contact (overlap) with, first liquid in a configuration in which ejections of the first liquid and the second liquid are controlled based on the same image data.

The present invention provides an image recording apparatus, comprising: a conveyor mechanism configured to convey a recording medium in a conveying direction; a first-liquid ejection head having a first ejection opening through which the first-liquid ejection head ejects first liquid for recording an image on the recording medium; a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction; an image-data storage section configured to store therein image data based on which the image is recorded; a waveform storage section configured to store therein a plurality of waveforms each defining at least one of an ejection amount of the first liquid to be ejected from the first ejection opening and an ejection amount of the second liquid to be ejected from the second ejection opening; and a controller configured to: select, based on the image data one waveform of the plurality of waveforms stored in the waveform storage section for each of a plurality of pixels arranged in matrix, the one waveform corresponding to an ejection amount of the first liquid to be ejected for one pixel, and supply, to the first-liquid ejection head, a drive signal based on the one waveform corresponding to the ejection amount of the first liquid; select, based on the image data, one waveform of the plurality of waveforms stored in the waveform storage section for each of the plurality of pixels, the one waveform corresponding to an ejection amount of the second liquid to be ejected for one pixel, and supply, to the second-liquid ejection head, a drive signal based on the one waveform corresponding to the ejection amount of the second liquid; determine whether recording of a test pattern using the second liquid is required; and when the recording of the test pattern using the second liquid is required, select the waveform such that the first liquid is not ejected from the first ejection opening.

The present invention also provides a method for producing a test pattern in an image recording apparatus including: a conveyor mechanism configured to convey a recording medium in a conveying direction; a first-liquid ejection head having a first ejection opening through which the first-liquid ejection head ejects first liquid for recording an image on the recording medium; a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction; an image-data storage section configured to store therein image data based on which the image is recorded; and a waveform storage section configured to store therein a plurality of waveforms each defining at least one of an ejection amount of the first liquid to be ejected from the first ejection opening and an ejection amount of the second liquid to be ejected from the second ejection opening, the method comprising: a first waveform selection step of, based on the image data, selecting one waveform of the plurality of waveforms stored in the waveform storage section for each of a plurality of pixels arranged in matrix, the one waveform corresponding to an ejection amount of the first liquid to be ejected for one pixel, and supplying, to the first-liquid ejection head, a drive signal based on the one waveform corresponding to the ejection amount of the first liquid; a second waveform selection step of, based on the image data, selecting one waveform of the plurality of waveforms stored in the waveform storage section for each of the plurality of pixels, the one waveform corresponding to an ejection amount of the second liquid to be ejected for one pixel, and supplying, to the second-liquid ejection head, a drive signal based on the one waveform corresponding to the ejection amount of the second liquid; and a determination step of determining whether recording of a test pattern using the second liquid is required, wherein the first waveform selection step is a step of selecting the waveform such that the first liquid is not ejected from the first ejection opening when the recording of the test pattern using the second liquid is required.

The present invention also provides a nontransitory storage medium storing a program to be executed by a computer of an image recording apparatus including: a conveyor mechanism configured to convey a recording medium in a conveying direction; a first-liquid ejection head having a first ejection opening through which the first-liquid ejection head ejects first liquid for recording an image on the recording medium; and a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction, the program being designed to have the computer function as: an image-data storage section configured to store therein image data based on which the image is recorded; a waveform storage section configured to store therein a plurality of waveforms each defining at least one of an ejection amount of the first liquid to be ejected from the first ejection opening and an ejection amount of the second liquid to be ejected from the second ejection opening; and a controller, configured to select, based on the image data, select one waveform of the plurality of waveforms stored in the waveform storage section for each of a plurality of pixels arranged in matrix, the one waveform corresponding to an ejection amount of the first liquid to be ejected for one pixel, and supply, to the first-liquid ejection head, a drive signal based on the one waveform corresponding to the ejection amount of the first liquid; select, based on the image data, select one waveform of the plurality of waveforms stored in the waveform storage section for each of the plurality of pixels, the one waveform corresponding to an ejection amount of the second liquid to be ejected for one pixel, and supply, to the second-liquid ejection head, a drive signal based on the one waveform corresponding to the ejection amount of the second liquid; determine whether recording of a test pattern using the second liquid is required; and when the recording of the test pattern using the second liquid is required, select the waveform such that the first liquid is not ejected from the first ejection opening.

The present invention also provides an image recording apparatus, comprising: a conveyor mechanism configured to convey a recording medium in a conveying direction; a first-liquid ejection head having a first ejection opening through which the first-liquid ejection head ejects first liquid for recording an image on the recording medium; a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction; an image-data storage section configured to store therein image data based on which the image is recorded; and a controller configured to: determine, based on the image data, an ejection amount of the first liquid to be ejected for each of a plurality of pixels, and supply, to the first-liquid ejection head, a drive signal corresponding to the determined ejection amount of the first liquid; determine, based on the image data, an ejection amount of the second liquid to be ejected for each of the plurality of pixels, and supply, to the second-liquid ejection head, a drive signal corresponding to the determined ejection amount of the second liquid; and determine whether recording of a test pattern using the second liquid is required; and when the recording of the test pattern using the second liquid is required, supply the drive signal to the first-liquid ejection head such that the first liquid is not ejected from the first ejection opening.

The present invention also provides an image recording apparatus, comprising: a conveyor mechanism configured to convey a recording medium in a conveying direction; a first-liquid ejection head having a first ejection opening through which the first-liquid ejection head ejects first liquid for recording an image on the recording medium; a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction; an image-data storage section configured to store therein image data based on which the image is recorded; a waveform storage section configured to store therein a plurality of waveforms each defining at least one of an ejection amount of the first liquid to be ejected from the first ejection opening and an ejection amount of the second liquid to be ejected from the second ejection opening; a first waveform selection section configured to, based on the image data, select one waveform of the plurality of waveforms stored in the waveform storage section for each of a plurality of pixels arranged in matrix, the one waveform corresponding to an ejection amount of the first liquid to be ejected for one pixel, and supply, to the first-liquid ejection head, a drive signal based on the one waveform corresponding to an ejection amount of the first liquid; a second waveform selection section configured to based on the image data, select one waveform of the plurality of waveforms stored in the waveform storage section for each of the plurality of pixels, the one waveform corresponding to an ejection amount of the second liquid to be ejected for one pixel; a first drive-signal supply section configured to supply, to the first-liquid ejection head, a drive signal based on the waveform selected by the first waveform selection section; a second drive-signal supply section configured to supply, to the second-liquid ejection head, a drive signal based on the waveform selected by the second waveform selection section; and a second-liquid test-pattern recording command section configured to command recording of a test pattern using the second liquid, wherein, when the second-liquid test-pattern recording command section is commanding the recording of the test pattern using the second liquid, the first waveform selection section selects the waveform such that the first liquid is not ejected from the first ejection opening.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 4A and 43 are views for explaining a function of an ink-waveform selection section shown in FIG. 2;

DETAILED DESCRIPTION OF THE EMBODIMENT

Hereinafter, there will be described one embodiment of the present invention by reference to the drawings.

Figure 1:
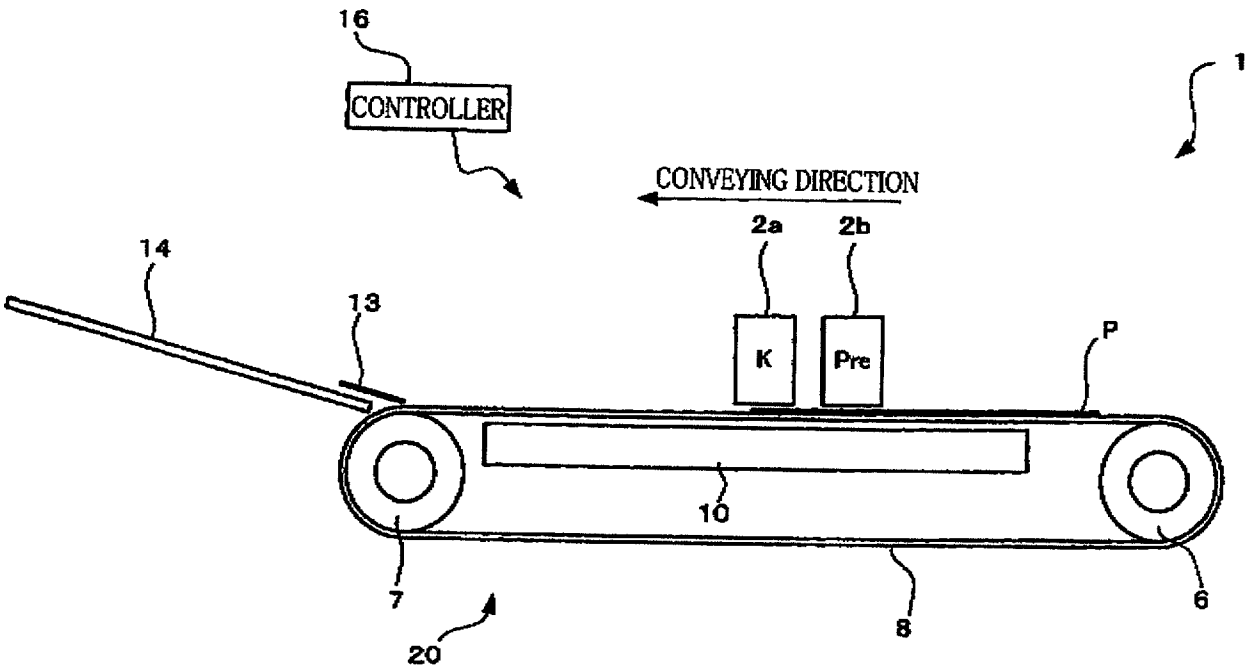
FIG. 1 is a side view generally showing an ink-jet printer as one embodiment of the present invention.

As shown in FIG. 1, an ink-jet printer 1 includes a conveyor mechanism 20, an ink head 2*a* (as one example of a first-liquid ejection head), a precoat head 2*b* (as one example of a second-liquid ejection head), and a controller 16. The ink head 2*a* has ejection openings formed therein for ejecting droplets of black ink (K) (as one example of first liquid) onto a recording medium in the form of a sheet P conveyed by the conveyor mechanism 20. The precoat head 2*b* has ejection openings formed therein for ejecting droplets of precoat liquid (Pre) (as one example of second liquid) that coagulates or precipitates a coloring agent of the ink.

In the conveyor mechanism 20, belt rollers 6, 7 are rotated to rotate a conveyor belt 8, whereby the sheet P placed on the conveyor belt 8 is conveyed through positions between the heads 2*a*, 2*b* and a platen 10. When the sheet P is conveyed through a position just under the precoat head 2*b*, the precoat head 2*b* ejects droplets of the precoat liquid so as to apply the precoat liquid on areas on which an image is to be formed on an upper face of the sheet P. Then, when the sheet P is conveyed through a position just under the ink head 2*a*, the ink head 2*a* ejects the ink droplets onto the areas on which the precoat liquid has been applied on the upper face of the sheet P. As a result, a desired image is formed on the sheet P. When the ink droplet is landed on the precoat liquid on the sheet P, the precoat liquid acts on the ink droplet and coagulates or precipitates the coloring agent of the ink droplet, thereby preventing ink spreading on the sheet P. Precoat liquid for coagulating pigments is used for pigment ink, and precoat liquid for precipitating dyes is used for dye ink. The precoat liquid may be any suitable liquid such as liquid containing a cationic high polymer and/or polyvalent metal salt such as magnesium salt. When the ink is landed on the area on the sheet P on which the precoat liquid has been applied, the polyvalent metal salt or the like coagulates or precipitates the dyes or the pigments as the coloring agent of the ink, thereby forming an insoluble or hardly soluble metal complex and so on. As a result, a degree of penetration of the landed ink into the sheet P is lowered, which facilitates fixing the ink on the sheet P. The sheet P on which the image has been recorded is peeled from the conveyor belt 8 by a peeling plate 13 and discharged onto a sheet-discharge portion 14.

Figure 2:
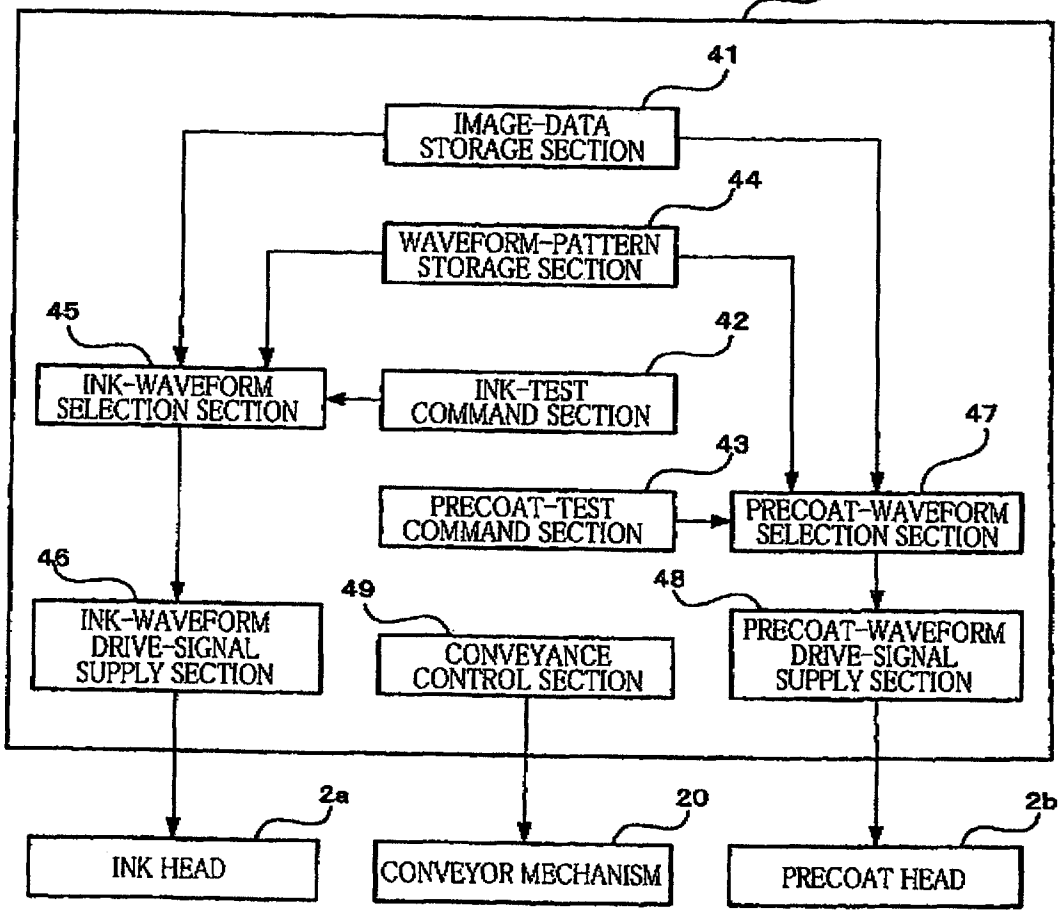
FIG. 2 is a functional block diagram of a controller shown in FIG. 1.

There will be next explained the controller 16 with reference to FIG. 2. As shown in FIG. 2, the controller 16 includes various functional sections such as an image-data storage section 41, an ink-test command section 42 (as one example of a first-liquid test-pattern recording command section), a precoat-test command section 43 (as one example of a second-liquid test-pattern recording command section), a waveform-pattern storage section 44 (as one example of a waveform storage section), an ink-waveform selection section 45 (as one example of a first waveform selection section), an ink-waveform drive-signal supply section 46 (as one example of a first drive-signal supply section), a precoat-waveform selection section 47 (as one example of a second waveform selection section), a precoat-waveform drive-signal supply section 48 (as one example of a second drive-signal supply section), and a conveyance control section 49. The controller 16 further includes: a central processing unit (CPU); an electrically erasable and programmable read only memory (EEPROM) rewritably storing therein programs to be executed by the CPU and data used for these programs; and a random access memory (RAM) temporarily storing therein data upon execution of the programs. These various functional sections are constituted by cooperation of these hardware and software in the EEPROM with each other. These programs are stored in various recording media such as a flexible disc, a CD-ROM, and a memory card, and installed into the EEPROM from these recording media. It is noted that the control programs stored in the recording media may be executed directly by the CPU and may be programs that become executable by being installed into the EEPROM. Further, the control programs may be encrypted and/or compressed. The image-data storage section 41 stores image data transmitted from an external device and received together with a recording command. This image data contains a gray level value (one of 0-255 in the present embodiment) for each of a plurality of pixels arranged in matrix.

The ink-test command section 42 commands recording of an ink test (examination) pattern in units of pixels. The ink test pattern is used for a calibration for the ink head 2*a*. The precoat-test command section 43 commands recording of a precoat test (examination) pattern in units of pixels. The precoat test pattern is used for a calibration for the precoat head 2*b*. The recording command for the ink test pattern by the ink-test command section 42 and the recording command for the precoat test pattern by the precoat-test command section 43 are not outputted for one pixel at the same time. A request for each of the precoat test pattern and the ink test pattern is normally contained in the recording command. Each of the ink-test command section 42 and the precoat-test command section 43 outputs a command based on the request. It is noted that the request for each of the precoat test pattern and the ink test pattern may be inputted into the controller 16 by a user.

Figure 3:
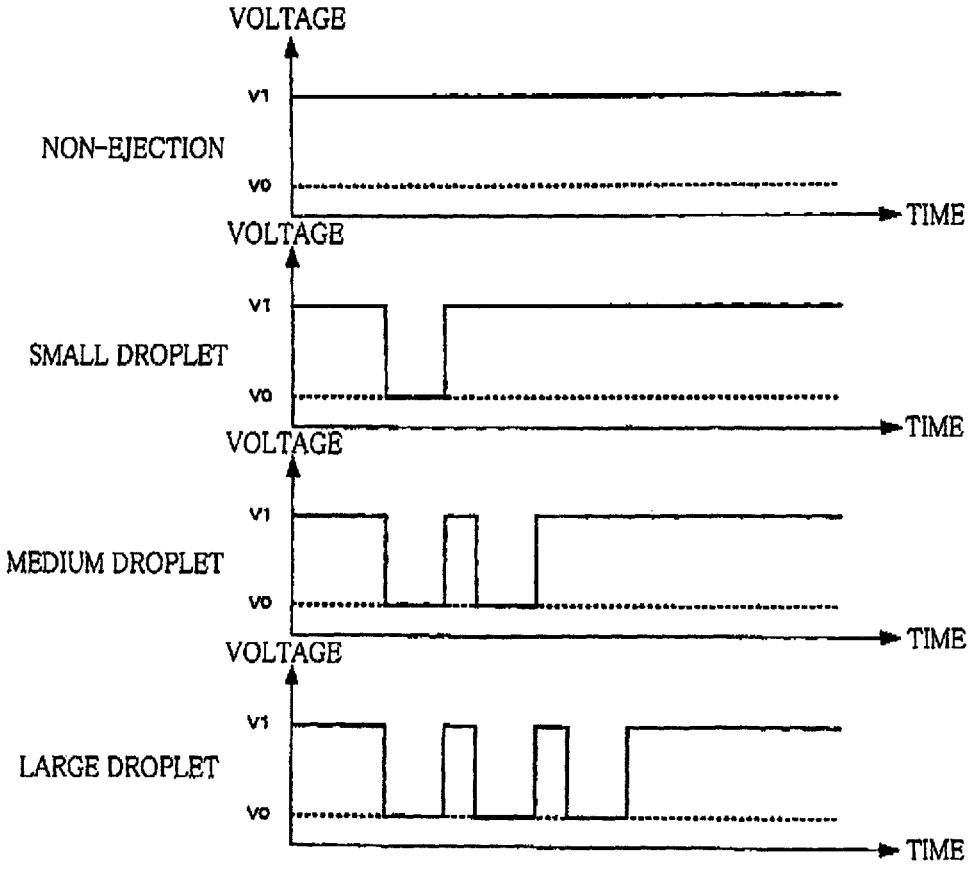
FIG. 3 is one example of waveform patterns stored in a waveform-pattern storage section shown in FIG. 2.

The waveform-pattern storage section 44 stores four waveform patterns each defining or representing an amount of the ink or the precoat liquid to be ejected from the ejection openings of the head 2*a* or 2*b*. As shown in FIG. 3, the four waveform patterns respectively cause the head 2*a* or 2*b* to eject no droplet (non-ejection), a small droplet, a medium droplet, and a large droplet of the ink or the precoat liquid from the ejection openings, in order from an upper side of a table in FIG. 3 in the present embodiment. It is noted that, in each waveform pattern, a voltage is kept at a predetermined voltage V1 in a normal situation, and when a liquid droplet is ejected, the voltage is temporarily reduced from V1 to V0 and then increased from V0 to V1 when a predetermined length of time has passed from the reduction. In the present embodiment, a liquid ejection mechanism of each of the ink head 2*a* and the precoat head 2*b* is constituted by piezoelectric actuators of what is called a unimorph type. Thus, a potential difference shown in FIG. 3 is applied to two electrodes arranged so as to sandwich a piezoelectric element constituting the piezoelectric actuator, whereby the piezoelectric element is deformed to apply an ejection energy to the liquid. Further, in the present embodiment, the ejection energy to be applied to the liquid is increased and thereby the amount of the liquid to be ejected is increased in each waveform in which the voltage is reduced from V1 to V0 and then increased from V0 to V1 when the predetermined length of time has passed from the reduction.

As shown in FIGS. 4A and 4B, the ink-waveform selection section 45 quaternary-converts the gray level value of the 256 gray levels to one of four values ("00"-"11") in each pixel of the image data by using three threshold values. The ink-waveform selection section 45 then determines the ejection amount (i.e., one of the non-ejection, the small droplet, the medium droplet, and the large droplet) based on the value obtained by the quaternary conversion. The ink-waveform selection section 45 then selects a waveform pattern corresponding to the determined ejection amount from among the waveform patters stored in the waveform-pattern storage section 44. When the precoat-test command section 43 is commanding the recording of the precoat test pattern, the ink-waveform selection section 45 changes the smallest one of the three threshold values (as one example of a first threshold value) to a value greater than the threshold values in the normal recording such that the determined ejection amount becomes zero.

For example, as shown, in FIG. 4A, the three threshold values are "63", "127", and "191". In the normal recording, when the gray level value is equal to or less than the threshold value "63" ("0"-"63"), the ink-waveform selection section 45 quaternary-converts the gray level value to "00" and determines the ejection amount at "0". When the gray level value is greater than the threshold value "63" and equal to or less than "127" ("64"-"127"), the ink-waveform selection section 45 quaternary-converts the gray level value to "01" and determines the ejection amount at the small droplet. When the gray level value is greater than the threshold value "127" and equal to or less than "191" ("128"-"191"), the ink-waveform selection section 45 quaternary-converts the gray level value to "10" and determines the ejection amount at the medium droplet. When the gray level value is greater than the threshold value "191" ("192"-"255"), the ink-waveform selection section 45 quaternary-converts the gray level value to "11" and determines the ejection amount at the large droplet. As shown in FIG. 4B, when the precoat-test command section 43 is commanding the recording of the precoat test pattern, the ink-waveform selection section 45 changes the smallest threshold value from "63" to "255", whereby all the gray level values are quaternary-converted to "00", and the ejection amount is determined at "0" where the gray level value is equal to or greater than "0" and equal to or less than "255", that is, even where the gray level value is any value. That is, when the precoat-test command section 43 is commanding the recording of the precoat test pattern, the precoat-waveform selection section 47 determines, for a pixel having a first gray level value, the ejection amount of the precoat liquid at a value greater than zero, and the ink-waveform selection section 45 determines, for the pixel having the first gray level value, the ejection amount of the ink at zero. As a result, when the precoat test pattern is recorded, the ink is not ejected. Thus, it is possible to record or print the precoat test pattern only by the precoat liquid without its contact (overlap) with the ink.

Returning to FIG. 2, the ink-waveform drive-signal supply section 46 supplies or transmits a drive signal to the ink head 2*a*. This drive signal contains the waveform pattern selected by the ink-waveform selection section 45. As a result, the amount of the ink to be ejected from each ejection opening of the ink head 2*a* is controlled.

The precoat-waveform selection section 47 quaternary-converts the gray level value of the 256 gray levels to one of four values in each pixel of the image data by using three threshold values that are the same as those used in the ink-waveform selection section 45. The precoat-waveform selection section 47 then determines the ejection amount (i.e., one of the non-ejection, the small droplet, the medium droplet, and the large droplet) based on the value obtained by the quaternary conversion. The precoat-waveform selection section 47 then selects a waveform pattern corresponding to the determined ejection amount from among the waveform patters stored in the waveform-pattern storage section 44. When the ink-test command section 42 is commanding the recording of the ink test pattern, the precoat-waveform selection section 47 changes the smallest one of the three threshold values (as one example of a second threshold value) to a value greater than the threshold values in the normal recording such that the determined ejection amount becomes zero. Specific controls are substantially the same as those of the ink-waveform selection section 45 (see FIGS. 4A and 4B). As a result, when the ink test pattern is recorded, the precoat liquid is not ejected. Thus, it is possible to record or print the ink test pattern only by the ink without its contact (overlap) with the precoat liquid.

The precoat-waveform drive-signal supply section 48 supplies or transmits a drive signal to the precoat head 2*b*. This drive signal contains the waveform pattern selected by the precoat-waveform selection section 47. As a result, the amount of the precoat liquid to be ejected from each ejection opening of the precoat head 2*b* is controlled.

The conveyance control section 49 controls the conveyor mechanism 20 such that the sheet P is conveyed at a predetermined speed.

Figure 5:
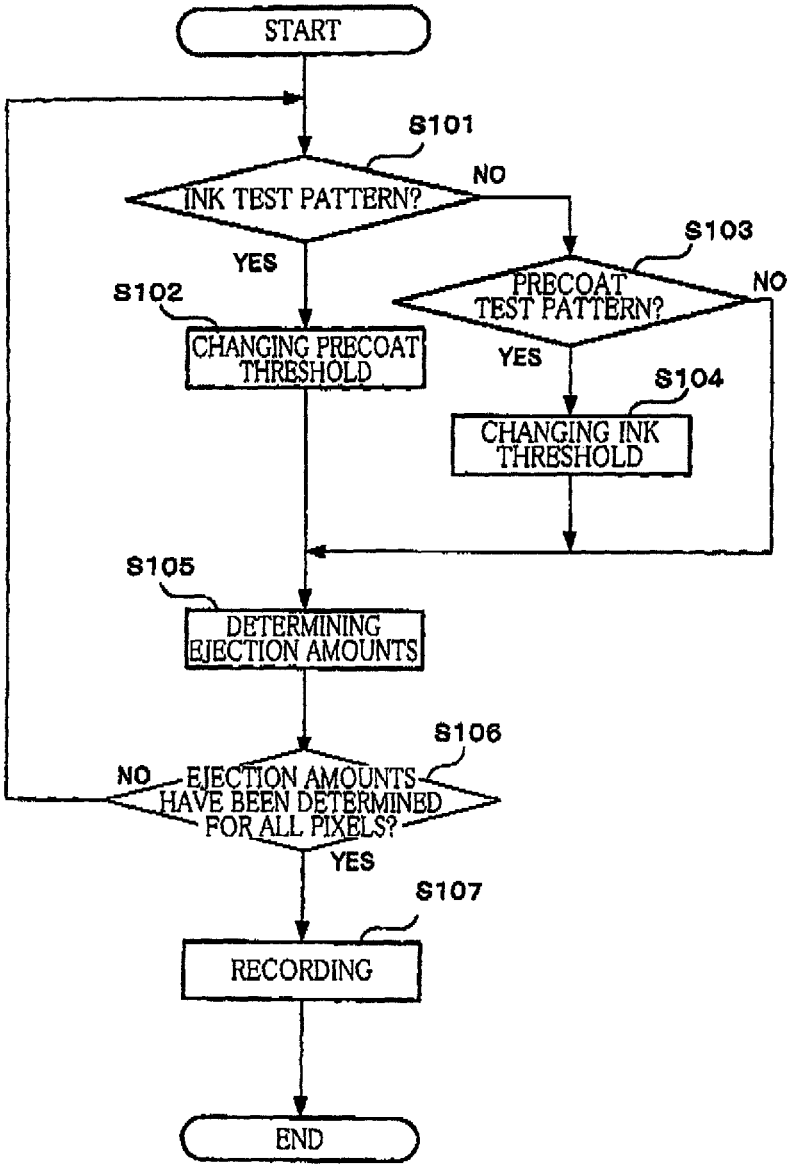
FIG. 5 is a flow-chart showing a recording operation of the ink-jet printer shown in FIG. 1.

There will be next explained the recording operation of the ink jet printer 1 with reference to FIG. 5. As shown in FIG. 5, when the recording command is received, the precoat-waveform selection section 47 in S101 judges for one pixel whether the ink-test command section 42 is commanding the recording of the ink test pattern. When the ink-test command section 42 is commanding the recording of the ink test pattern (S101: YES), the precoat-waveform selection section 47 in S102 changes the threshold value such that the ejection amount of the precoat liquid becomes zero.

When the ink-test command section 42 is not commanding the recording of the ink test pattern (S101: NO), the ink-waveform selection section 45 in S103 judges whether the precoat-test command section 43 is commanding the recording of the precoat test pattern. When the precoat-test command section 43 is commanding the recording of the precoat test pattern (S103: YES), the ink-waveform selection section 45 in S104 changes the threshold value such that the ejection amount of the ink becomes zero. When the precoat-test command section 43 is not commanding the recording of the precoat test pattern (S103: NO), the precoat-waveform selection section 47 and the ink-waveform selection section 45 do not change the threshold value.

In S105, the precoat-waveform selection section 47 and the ink-waveform selection section 45 determine the ejection amounts of the precoat liquid and the ink based on the threshold values for the pixel and store the determined ejection amounts into a work area in the RAM. At this time, where the threshold value has been changed by the precoat-waveform selection section 47 after the ejection amount of the precoat liquid had been determined or the ink-waveform selection section 45 after the ejection amount of the ink had been determined, the threshold value is initialized. Then in S106, where the ejection amounts have not been determined for each of all the pixels (S106: NO), the above-described processings are executed for the next pixel. Where the ejection amounts have been determined for each of all the pixels (S106: YES), the recording is performed in S107 based on the determined ejection amounts, and this flow in FIG. 5 is finished.

Figure 6A:
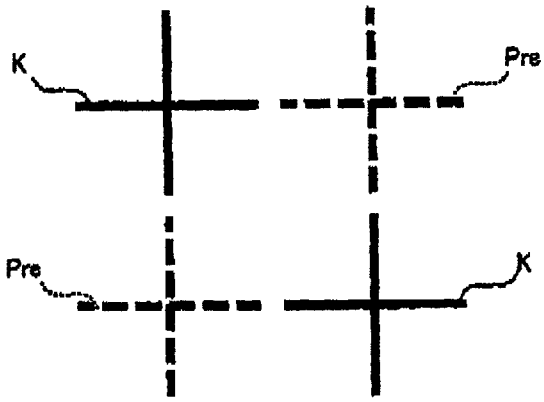
FIGS. 6A-6C are views showing one example of a test pattern recorded according to the flow-chart shown in FIG. 5.
Figure 6B:
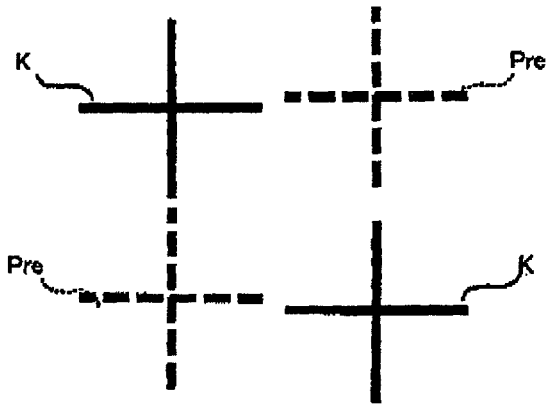
Figure 6C:
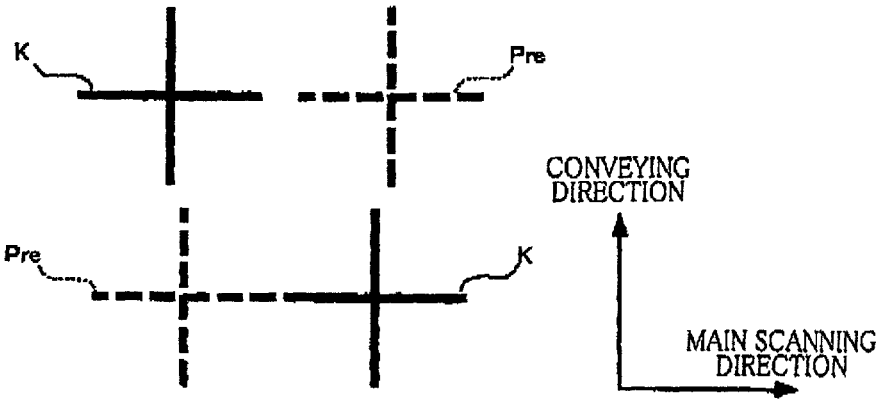

There will be next explained one example of the test pattern recorded according to the above-described processings with reference to FIGS. 6A-6C. In FIGS. 6A-6C, cross marks drawn in solid lines indicate the ink test patterns, and cross marks drawn in broken lines indicate the precoat test patterns. It is noted that the precoat test pattern is colorless but can be visually recognized by the user using a specific light or camera. As shown in FIG. 6A, in this test pattern, the ink test patterns and the precoat test patterns are alternately arranged in both of a conveying direction in which the sheet P is conveyed and a main scanning direction that is perpendicular to the conveying direction. In a test (examination) processing of the ink-jet printer 1, a registration is performed using the recorded test pattern to adjust a displacement between a position at which the ink is ejected and a position at which the precoat liquid is ejected. There will be explained one example of the registration.

FIG. 6A shows the test pattern in the case where the registration has been completed. In a case where there is displacement between ejection timings of the ink head 2*a* and the precoat head 2*b*, even if the recording operation is performed such that the test pattern shown in FIG. 6A is to be formed, each of the ink test patterns and a corresponding one of the precoat test patterns, as shown in FIG. 6B, are displaced from each other in the conveying direction in the recorded test pattern. In a case where there is displacement between fixed positions of the ink head 2*a* and the precoat head 2*b* in the main scanning direction, even if the recording operation is performed such that the test pattern shown in FIG. 6A is to be formed, each of the ink test patterns and a corresponding one of the precoat test patterns, as shown in FIG. 6C, are displaced from each other in the main scanning direction in the recorded test pattern. The registration is completed by adjusting the ejection timings and the fixed positions of the heads 2*a*, 2*b* such that the test pattern shown in FIG. 6A is to be recorded in which each of the ink test patterns and a corresponding one of the precoat test patterns are aligned to each other in the conveying direction and the main scanning direction. It is noted that only the ejection timing and the fixed position of the precoat head 2*b* may be adjusted using the ink head 2*a* as a reference, and alternatively, only the ejection timing and the fixed position of the ink head 2*a* may be adjusted using the precoat head 2*b* as a reference.

In the ink-jet printer 1 as the present embodiment, when the precoat test pattern is recorded on the sheet P, the ink-waveform selection section 45 selects the waveform pattern not causing the ejection of the ink. Thus, it is possible to record the precoat test pattern only by the precoat liquid without its contact with the ink.

The ink-jet printer 1 has a simple configuration in which the ink-waveform selection section 45 increases the smallest threshold value in order not to eject the ink when the precoat test pattern is recorded on the sheet P.

Further, when the ink test pattern is recorded on the sheet P, the precoat-waveform selection section 47 selects the waveform pattern not causing the ejection of the precoat liquid. Thus, it is possible to record the ink test pattern only by the ink without its contact with the precoat liquid.

The ink jet printer 1 has a simple configuration in which the precoat-waveform selection section 47 increases the smallest threshold value in order not to eject the precoat liquid when the ink test pattern is recorded on the sheet P.

<Modifications>

In the above-described embodiment, when the precoat test pattern is recorded on the sheet P, the ink-waveform selection section 45 increases the smallest threshold value to select the waveform pattern not causing the ejection of the ink, and when the ink test pattern is recorded on the sheet P, the precoat-waveform selection section 47 increases the smallest threshold value to select the waveform pattern not causing the ejection of the precoat liquid. However, the present invention is not limited to this configuration. For example, this printer 1 may be configured such that, when the precoat test pattern is recorded on the sheet P, the ink-waveform selection section 45 forcefully determines the ejection amount at zero to select the waveform pattern not causing the ejection of the ink and such that, when the ink test pattern is recorded on the sheet P, the precoat-waveform selection section 47 forcefully determines the ejection amount at zero to select the waveform pattern not causing the ejection of the precoat liquid. Further, this printer 1 may be configured such that, when the precoat test pattern is recorded on the sheet P, the ink-waveform selection section 45 unconditionally selects the waveform pattern not causing the ejection of the ink without changing the threshold value and the ejection amount and such that when the ink test pattern is recorded on the sheet P, the precoat-waveform selection section 47 unconditionally selects the waveform pattern not causing the ejection of the precoat liquid without changing the threshold value and the ejection amount. In these configurations, it is possible to inhibit the ink or the precoat liquid from being ejected with a simple configuration.

While the embodiment of the present invention has been described above, it is to be understood that the invention is not limited to the details of the illustrated embodiment, but may be embodied with various changes and modifications, which may occur to those skilled in the art, without departing from the spirit and scope of the invention. For example, in the above-described embodiment, the precoat liquid is not ejected when the ink test pattern is recorded on the sheet P, but the precoat liquid may be also ejected when the ink test pattern is recorded on the sheet P. It is noted that the precoat liquid is colorless and transparent, and thus even if the precoat liquid contacts or overlaps the ink, the ink test pattern can be used as in the above-described embodiment without loss of its function.

In the above-described embodiment, the recording command for the precoat test pattern and the recording command for the ink test pattern are judged in the units of the pixels such that the precoat test patterns and the ink test patterns can be recorded on one sheet. However, where the precoat test patterns and the ink test patterns are recorded in units of the sheets, the recording command for the precoat test pattern and the recording command for the ink test pattern may be judged based on the recording commands in the units of the sheets. Alternatively, the recording command for the precoat test pattern and the recording command for the ink test pattern may be judged in units of any areas on the sheet.

In the above-described embodiment, when the precoat test pattern is recorded, the ink-waveform drive-signal supply section 46 supplies to the ink head 2*a* the drive signal containing the waveform pattern whose the ejection amount is zero and which has been selected by the ink-waveform selection section 45, whereby the amount of the ink to be ejected from the ejection opening(s) of the ink head 2*a* is made zero, but the present invention is not limited to this configuration. For example, the printer 1 may be configured such that, when the precoat test pattern is recorded, the ink-waveform selection section 45 does not select any waveform pattern, and the ink-waveform drive-signal supply section 46 continuously supplies to the ink head 2*a* the drive signal containing the waveform pattern whose the ejection amount is zero, over a period in which the precoat test pattern is recorded. Likewise, the printer 1 may be configured such that, when the ink test pattern is recorded, the precoat-waveform selection section 47 does not select any waveform pattern, and the precoat-waveform drive-signal supply section 48 continuously supplies to the precoat head 2*b* the drive signal containing the waveform pattern whose the ejection amount is zero, over a period in which the ink test pattern is recorded.

In the above-described embodiment, the single CPU executes all of the processings, but the present invention is not limited to this configuration. For example, a plurality of CPUs, an application-specific integrated circuit (ASIC), or a combination of the CPU and the ASIC may be used to execute the processings.

The present invention is applicable to a liquid ejection apparatus configured to eject liquid other than the ink. The application of the present invention is not limited to the printer, and the present invention is applicable to various devices for image recording such as a facsimile machine and a copying machine.

What is claimed is:

1. An image recording apparatus, comprising:

a conveyor mechanism configured to convey a recording medium in a conveying direction;

a first-liquid ejection head having a first ejection opening through which the first-liquid ejection head ejects first liquid for recording an image on the recording medium;

a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction; and a controller configured to perform a test-recording processing in which a first test pattern and a second test pattern are recorded on the recording medium by the first-liquid ejection head and the second-liquid ejection head respectively, wherein the controller is configured to control the first-liquid ejection head such that the first liquid ejected from the first ejection opening does not land on a position of the second test pattern in the test-recording processing.

2. The image recording apparatus according to claim 1, further comprising an image-data storage section configured to store therein image data based on which the image is recorded, wherein the controller is configured to, based on the image data, determine the ejection amount of the first liquid to be ejected for each of a plurality of pixels arranged in a matrix, wherein the controller is configured to, based on the image data, determine an ejection amount of the second liquid to be ejected for each of the plurality of pixels, and wherein the controller is configured to control the first-liquid ejection head such that the first liquid ejected from the first ejection opening does not land on the position of the second test pattern in the test-recording processing regardless of the image data corresponding to the respective plurality of pixels.

3. The image recording apparatus according to claim 2, wherein the image data has a gray level value for each of the plurality of pixels, wherein the controller is configured to determine the ejection amount of the first liquid at zero when the gray level value is equal to or less than a first threshold value, wherein the controller is configured to determine the ejection amount of the second liquid at zero when the gray level value is equal to or less than a second threshold value, and wherein the controller is configured to increase the first threshold value such that the first liquid ejected from the first ejection opening does not land on the position of the second test pattern in the test-recording processing.

4. The image recording apparatus according to claim 2, further comprising a waveform storage section configured to store therein a plurality of waveforms each defining at least one of the ejection amount of the first liquid to be ejected from the first ejection opening and the ejection amount of the second liquid to be ejected from the second ejection opening, wherein the controller is configured to select one of the plurality of waveforms for each of the plurality of pixels such that the first liquid ejection ejected from the first ejection opening does not land on the position of the second test pattern in the test recording processing.

5. The image recording apparatus according to claim 1, wherein the controller is configured to control the second-liquid ejection head such that the second liquid ejected from the second ejection opening does not land on a position of the first test pattern in the test-recording processing.

6. The image recording apparatus according to claim 5, further comprising an image-data storage section configured to store therein image data based on which the image is recorded, wherein the controller is configured to, based on the image data, determine the ejection amount of the first liquid to be ejected for each of a plurality of pixels arranged in a matrix, wherein the controller is configured to, based on the image data, determine an ejection amount of the second liquid to be ejected for each of the plurality of pixels, and wherein the controller is configured to control the second-liquid ejection head such that the second liquid ejected from the second ejection opening does not land on the position of the first test pattern in the test-recording processing regardless of the image data corresponding to the respective plurality of pixels.

7. The image recording apparatus according to claim 6, wherein the image data has a gray level value for each of the plurality of pixels, wherein the controller is configured to determine the ejection amount of the first liquid at zero when the gray level value is equal to or less than a first value, wherein the controller is configured to determine the ejection amount of the second liquid at zero when the gray level value is equal to or less than a second threshold value, and wherein the controller is configured to increase the second threshold value such that the second liquid ejected from the second ejection opening does not land on the position of the first test pattern in the test-recording processing.

8. The image recording apparatus according to claim 6, further comprising a waveform storage section configured to store therein a plurality of waveforms each defining at least one of the ejection amount of the first liquid to be ejected from the first ejection opening and the ejection amount of the second liquid to be ejected from the second ejection opening, wherein the controller is configured to select one of the plurality of waveforms for each of the plurality of pixels such that the second liquid ejected from the second ejection opening does not land on the position of the first test pattern in the test recording processing.

9. A method for producing a test pattern in an image recording apparatus, the image recording apparatus comprising:

a conveyor mechanism configured to convey a recording medium in a conveying direction;

a first-liquid ejection head having a first ejection opening through which the first-liquid ejection head ejects first liquid for recording an image on the recording medium; and a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction, the method comprising:

performing a test-recording processing in which a first test pattern and a second test pattern are recorded on the recording medium by the first-liquid ejection head and the second-liquid ejection head respectively, wherein the test-recording processing comprises controlling the first-liquid ejection head such that the first liquid ejected from the first ejection opening does not land on a position of the second test pattern.

10. A nontransitory storage medium storing a program to be executed by a computer of an image recording apparatus, the image recording apparatus comprising:

a conveyor mechanism configured to convey a recording medium in a conveying direction;

a first-liquid ejection head having a first ejection opening through which the first-liquid ejection head ejects first liquid for recording an image on the recording medium; and a second-liquid ejection head having a second ejection opening through which the second-liquid ejection head ejects second liquid for coagulating or precipitating a constituent of the first liquid, the second-liquid ejection head being provided upstream of the first-liquid ejection head in the conveying direction, the program comprising computer-readable instructions that, when executed by the computer, instruct the computer to perform processes comprising:

a test-recording processing in which a first test pattern and a second test pattern are recorded on the recording medium by the first-liquid ejection head and the second-liquid ejection head respectively, wherein, in the test-recording processing, the first-liquid ejection head is controlled such that the first liquid ejected from the first ejection opening does not land on a position of the second test pattern.

* * * * *